US008713723B2

(12) United States Patent
Stern

(10) Patent No.: US 8,713,723 B2
(45) Date of Patent: May 6, 2014

(54) SWIMMING POOL COVER SYSTEM INCORPORATING GAP ELIMINATORS

(76) Inventor: Robert M. Stern, Toms River, NJ (US)

( * ) Notice: Subject to any disclaimer, the term of this patent is extended or adjusted under 35 U.S.C. 154(b) by 486 days.

(21) Appl. No.: 13/135,521

(22) Filed: Jul. 8, 2011

(65) Prior Publication Data

US 2012/0047645 A1 Mar. 1, 2012

Related U.S. Application Data

(60) Provisional application No. 61/402,288, filed on Aug. 27, 2010.

(51) Int. Cl.
*E04H 4/00* (2006.01)

(52) U.S. Cl.
USPC ..... 4/498

(58) Field of Classification Search
USPC ..... 4/498, 503
See application file for complete search history.

(56) References Cited

U.S. PATENT DOCUMENTS

| | | | | |
|---|---|---|---|---|
| 4,393,528 | A * | 7/1983 | West | 4/498 |
| 4,458,668 | A * | 7/1984 | Sheldon | 126/565 |
| 8,151,381 | B2 * | 4/2012 | Pesta | 4/503 |
| 8,359,681 | B2 * | 1/2013 | Hotaling | 4/498 |

* cited by examiner

*Primary Examiner* — Huyen Le
(74) *Attorney, Agent, or Firm* — Clifford G. Frayne

(57) ABSTRACT

An improved swimming pool cover system which incorporates a gap eliminator for use on pools which have walls of varying height and curvature, the gap eliminator secured to the wall by a cable and a plurality of anchors, the gap eliminator having a sleeve including a weighted buoyant material disposed below the pool cover attached to the cable and a second sleeve having buoyant weighted material disposed above the pool cover attached to the cable, thereby sealing the gap between the pool cover and the wall.

28 Claims, 14 Drawing Sheets

FIGURE 1
PRIOR ART
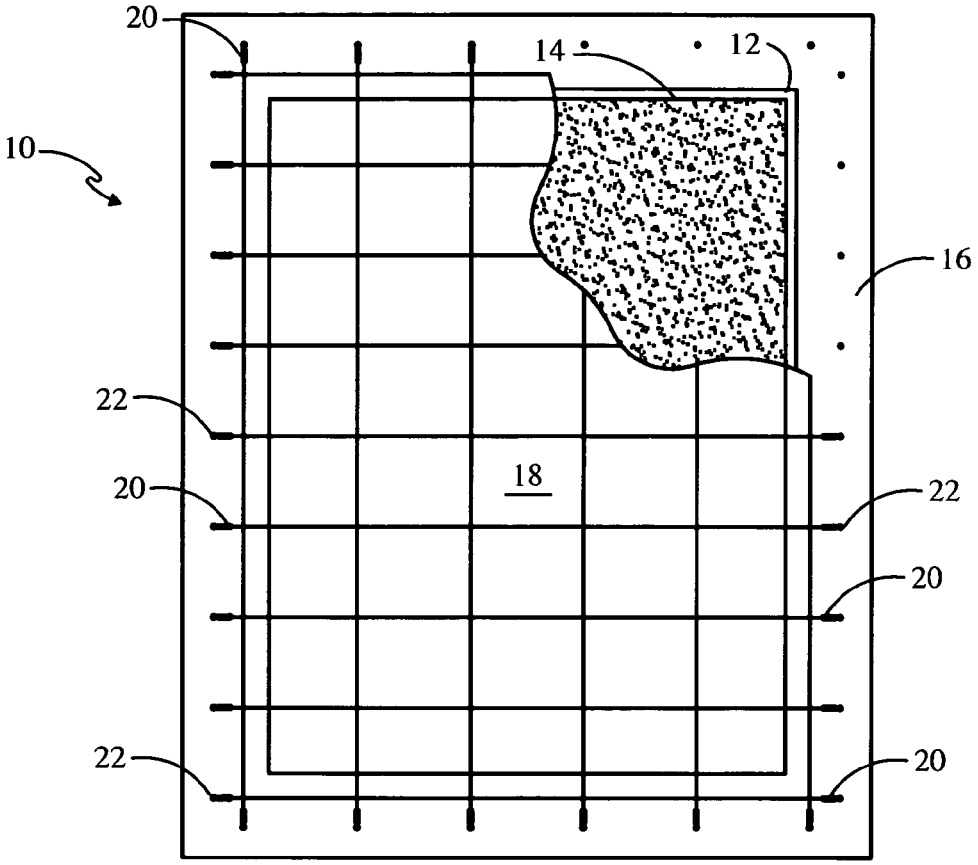
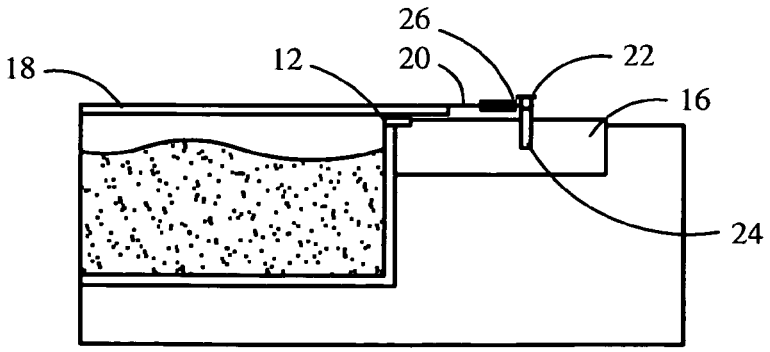
FIGURE 2
PRIOR ART

FIGURE 4 - PRIOR ART

FIGURE 5 - PRIOR ART

SWIMMING POOL COVER SYSTEM INCORPORATING GAP ELIMINATORS

RELATED APPLICATIONS

Applicant claims the benefit of provisional application Ser. No. 61/402,288, filed Aug. 27, 2010.

BACKGROUND OF THE INVENTION

1. Field of the Invention

The present invention relates to swimming pool covers, as they relate to raised wall shaped pools which have straight and arcuate walls which extend above the coping and deck of the pool which establish gaps in the pool cover coverage and in particular to a complimentary gap eliminating device cooperable with the swimming pool cover to insure complete coverage of the pool.

2. Description of the Prior Art

Covers for swimming pools are frequently used in climates where the pool is not used for certain periods of the year due to inclement weather. The pool cover is designed to be stretched across the pool and secured so as to prevent the ingress of dirt, waste material, or debris, such as fallen leaves during the off season. The cover also serves as a safety factor when the pool is not in use.

The swimming pool cover is typically a flexible, waterproof substrate or sheet of material, either impervious or fine mesh having a plurality of resilient, biased tie down straps secured about its periphery, the tie down straps being secured to a plurality of anchor bolts fixedly secured in the surrounding pool apron or deck, the resilient biased tie down straps being adjusted to achieve the desired tautness of the cover. In such a configuration, the pool cover covers the pool and the periphery of the surrounding deck or apron in an overlapping fashion, thus preventing ingress of debris into the pool during the off season.

Pool covers of the type described are easily installed on pools having a geometric shape, such as a rectangle, or an L-shape. They are also easily installed and effective with respect to pools, such as kidney-shaped pools and other pools having arcuate peripheries. In effect, covers of the type described are effective with respect to all pools in which the surrounding apron, deck or periphery is at one level or height.

A problem develops with respect to any shape pool which incorporates side walls of uneven height. The simplest example is a freeform pool which incorporates a waterfall, which waterfall flows over and into the pool from a rock wall or concave wall, the height of which is greater than that of the peripheral apron or decking of the pool.

Another example would be a freeform pool which incorporates a spa adjacent to the pool having a side wall higher than the peripheral apron or decking of the pool, and sharing a convex wall with the pool which may be of a different radius. In these instances, it is difficult to design a pool cover which will abut the curvatures of these walls having a height greater than that of the apron or decking of the pool.

Designs have been developed to secure a cover in as close approximation to these arcuate surfaces as possible, but in most cases there still remains a gap which allows for the ingress of dirt, leaves, and debris during the off season. This gap may further increase if the pool cover is subjected to loads such as snow or accumulated standing water. Still further, the gap varies as the pool cover installer adjusts the tension of the securing straps. Still further, this gap presents a safety problem due to its size, such that the possibility exists that a small pet or rodents could fall through this gap and into the underlying water.

Attempts have been made to provide a closure for the gap existing between the pool cover and the arcuate side wall. One such solution included the fastening of an additional waterproof flap to the end of the pool cover adjacent the arcuate wall and providing some weight and volume to this flap so that it would lie across the gap. This flap is commonly referred to in the trade as a bumper. The bumper is essentially an extension of the pool cover in that it is clipped or sewn to the edge of the cover. A sewn bumper proves difficult to fabricate and also to fold for storage when not in use. This has proved to be ineffective in that atmospheric conditions cause the clipped flap to disengage, pull away from the underlying pool cover or the wall, and fail to provide adequate and continued closure to the gap.

Applicant has developed an improved pool cover gap system which effectively closes the gap formed between a swimming pool cover and an arcuate or straight wall surface of greater height than the peripheral apron or decking about the pool, which is easily installed and provides an effective barrier to the passage and ingress of debris into the underlying water of the pool, and also closes the gap from a safety standpoint as it might relate to small pets or rodents.

OBJECTS OF THE INVENTION

An object of the present invention is to provide for a novel swimming pool cover gap system which secures the gap between a swimming pool cover and a wall of greater height than the peripheral apron or decking about the pool.

It is another object of the present invention to provide for a novel swimming pool cover system which secures to the elevated wall of the pool and overlaps the swimming pool cover above and below the cover, thereby sealing the gap between the swimming pool cover and an elevated straight or arcuate wall of the pool.

Another object of the present invention is to provide for a novel swimming pool cover gap system which includes a gap eliminator bumper which closes the gap between a swimming pool cover and an elevated straight or arcuate wall portion of the pool which provides for greater safety when the pool is closed.

It is a still further object of the present invention to provide for a novel swimming pool cover gap system which includes a gap eliminating bumper which maintains closure of the pool even when the swimming pool cover experiences a water load or a snow load which causes the pool cover to stretch.

It is a still further object of the present invention to provide for a novel swimming pool cover system which provides for a gap eliminator bumper which is compact and easily stored when not in use.

SUMMARY OF THE INVENTION

An improved swimming pool cover system which incorporates a gap eliminator for use on pools which have walls of varying height and curvature, the gap eliminator secured to the wall by a plurality of cable guides securing a support cable, the gap eliminator having a sleeve including a weighted buoyant material disposed below the pool cover attached to the cable and a second sleeve having weighted buoyant material disposed above the pool cover attached to the cable, thereby sealing the gap between the pool cover and the wall, the gap eliminator having an optional third sleeve adjacent the second sleeve having a weighed non-buoyant material disposed therein.

BRIEF DESCRIPTION OF THE DRAWINGS

These and other objects of the present invention will become apparent, particularly when taken in light of the following illustrations wherein:

FIG. 1 is a top view of a conventional pool cover of the prior art illustrating the manner of its installation;

FIG. 2 is a side view of the tie down straps utilized in conjunction with the pool cover of FIG. 1;

DETAILED DESCRIPTION OF THE INVENTION

Figure 3:
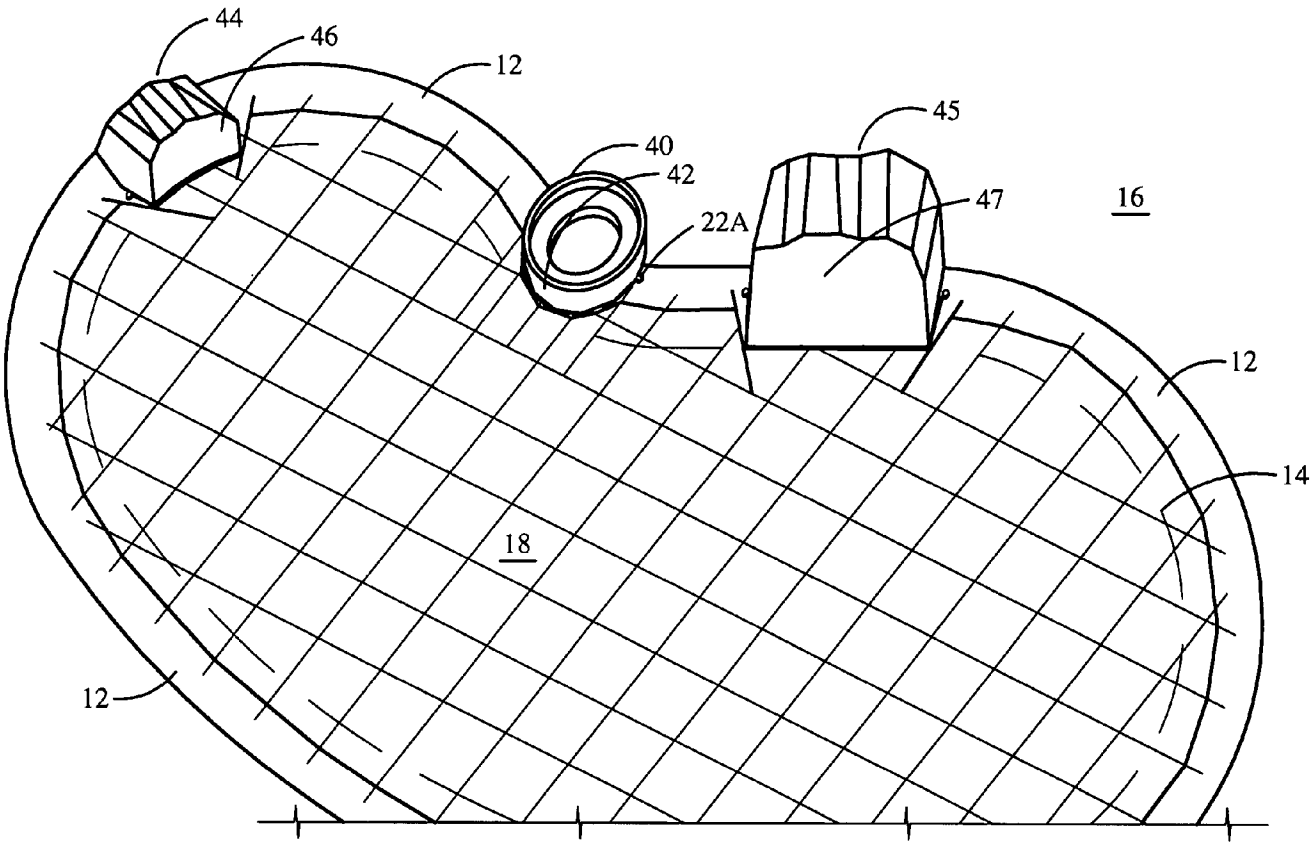
FIGURE 3 PRIOR ART
FIG. 3 is a perspective view of a free form pool which incorporates a waterfall and a spa which present a concave spatial surface and a convex spatial surface respectively, which extends above the decking or apron of the pool.
Figure 4:
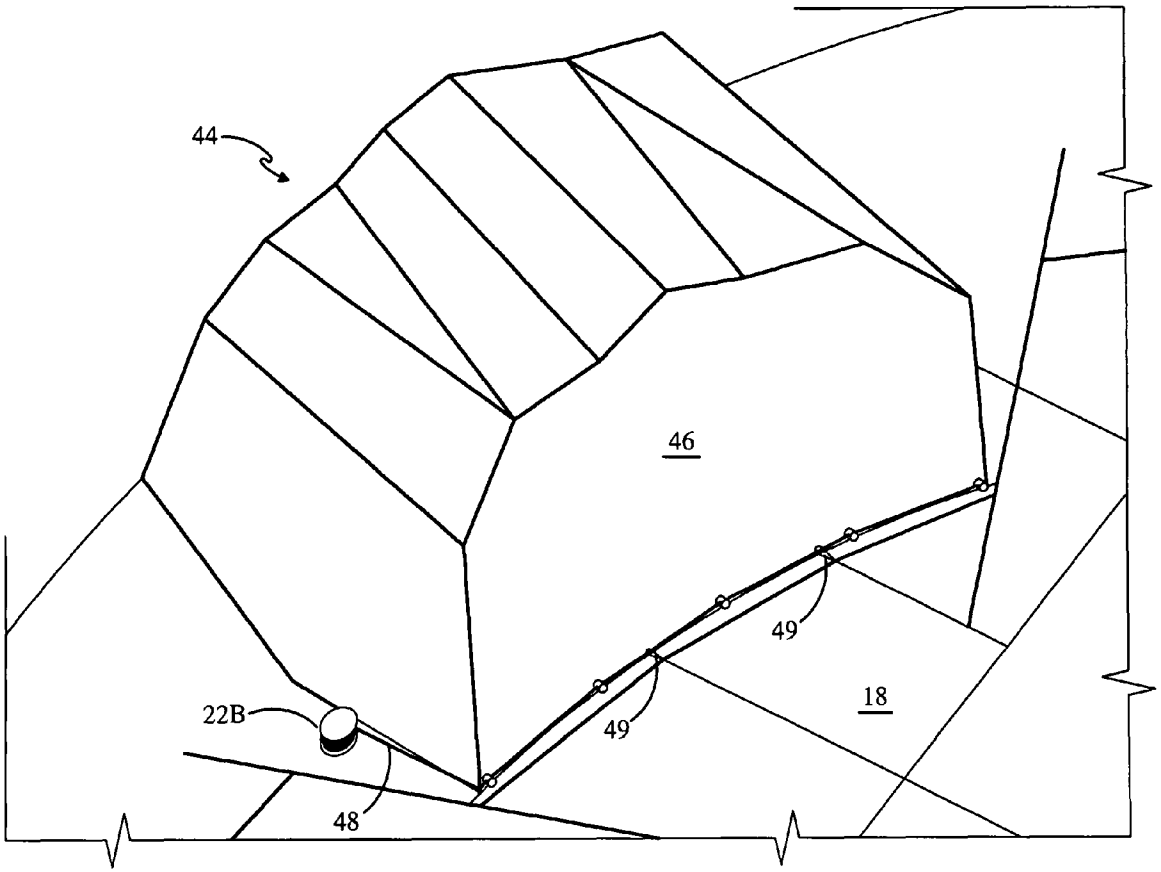
FIG. 4 is a front perspective view of the concave waterfall section illustrating the manner in which the prior art has attempted to extend a pool cover into this spatial area.

FIGS. 1 through 5 illustrate the state of the prior art in addressing the problem heretofore set forth.

FIG. 1 is a top view of a conventional pool cover installed over a pool to prevent the ingress of particulate matter and debris during the season when the pool is not in use.

FIG. 2 is a partial side view of a tie down strap associated with the pool cover of FIG. 1. The pool 10 illustrated in FIGS. 1 and 2 are generally rectangular in nature having an edging or coping 12 about its periphery 14, there extending outwardly from the coping a pool apron or decking 16 comprised of concrete, decorative stone, wood, or the like. The decking or apron 16 is substantially level with the coping or edging 12 of pool 10.

A pool of this type could be any shape as long as the coping and deck were on the same level. The cover 18 would be secured over the pool by securing a plurality of tie down straps 20 to a plurality of anchor bolts 22 which are secured in the apron or decking 16. The anchor bolts 22 are fitted into a recess cylinder housing 24 which is set in the decking or concrete apron 16 which allows the anchor bolt 22 to be recessed in its cylinder housing 24 during the pool season, but to be raised above the level of the apron or decking 16 so as to be engaged by a ring hook or spring assembly 26 on a particular tie down strap 20.

The cover 18 is unrolled across the pool with consecutive tie down straps 20 being engaged with selective anchor bolts 22 arranged about the pool. The tie down straps 20 themselves consist of adjustable cloth straps oftentimes incorporating a resilient strap in combination with a biasing spring means so as to the allow the installer to engage the tie down strap with the anchor bolt and then adjust the tie down straps to affect the desired tautness of the pool cover.

It should be noted that this design of pool cover and tie down straps is identical to the type of pool cover and tie down straps that would be utilized with the gap eliminator of the present invention. The problem with a free form pool is that it often contains elevated arcuate and straight wall portions which extend above the standard apron or decking level thereby presenting problems peculiar to the particular design and installation of the pool cover in order to provide cover and protection in these defined elevated areas.

FIG. 3 is a perspective view of a free form pool having many of the same elements as the pool illustrated in FIGS. 1 and 2, including coping 12, and apron or decking 16 about its periphery 14, however, the standard or common level of the apron or decking is interrupted by several raised walls. The owner has incorporated a hot tub/spa 40 in conjunction with the free form pool, the hot tub/spa 40 having a convex arcuate surface 42 extending into the pool area, and also extending above the apron or decking. The owner has also incorporated a waterfall 44 defined by a concave arcuate surface 46 also extending above the level of the apron or decking 16 and a waterfall 45 having a straight elevated surface 47. In these situations, the level of the apron or decking has been interrupted by the elevated walls of the hot tub/spa 40 and waterfalls 44 and 45, thereby denying the ability to position anchor bolts at a common level.

Figure 5:
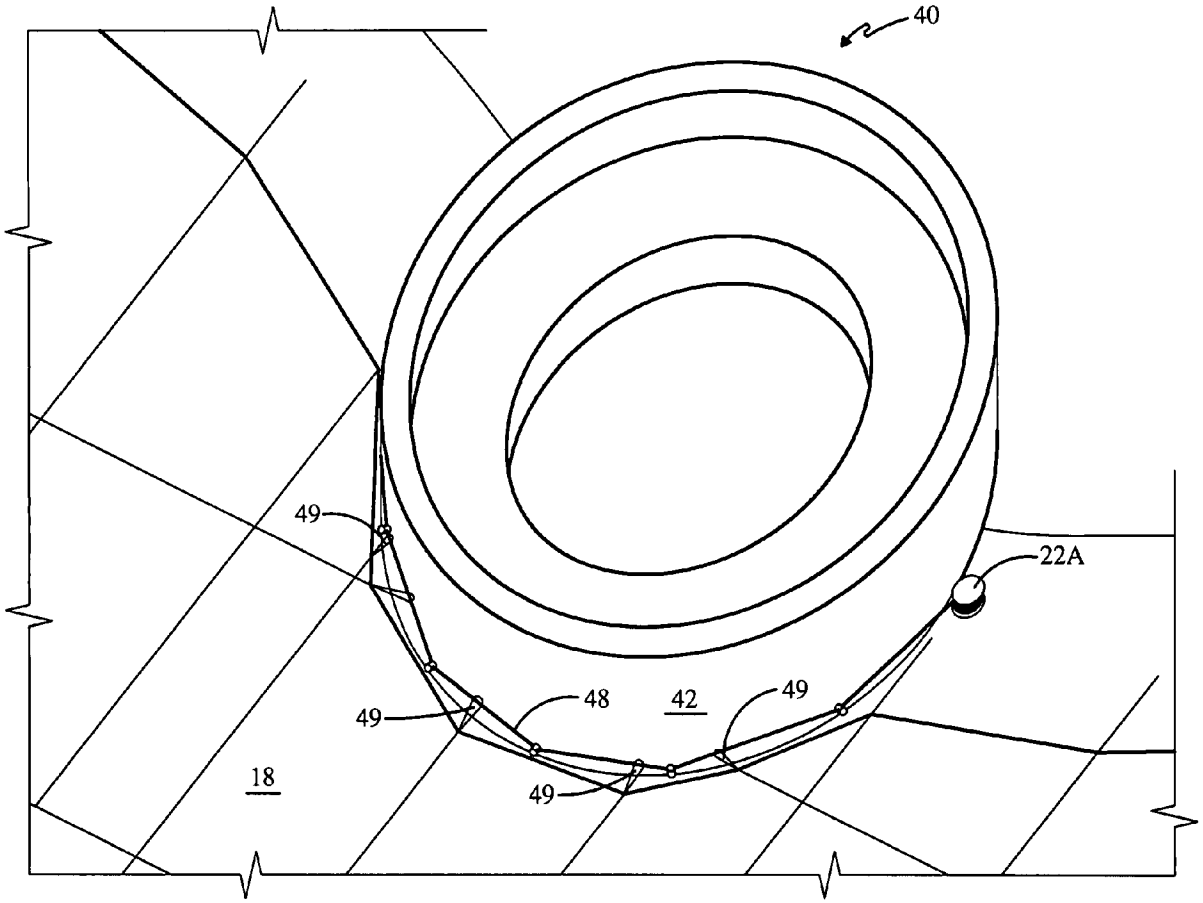
FIG. 5 is a perspective view of an arcuate, raised spa wall section illustrating the prior art solution to a convex wall problem.

The convex elevated wall of the spa hot tub 40 that projects into the pool area has been addressed by the use of the anchor bolts 22A and 22B (not shown) on either side of the hot tub spa 40 (See FIG. 5). These anchor bolts are utilized not only to engage the tie down straps of the pool cover, but are also utilized to stretch a taut cable 48 about the protruding circumference 42 of the hot tub/spa 40 that projects into the pool area. The pool cover is fabricated with clips or ties 49 on this portion of the pool cover which allow the installers to engage these clips or ties 49 on the taut cable 48. The taut cable 48 drawn about this portion of the hot tub spa 40 is level with the coping 12 and the deck or apron 16. However, in adjusting the tautness of the tie down straps 20 about the periphery of the pool by the installer, taut cable 48 will oftentimes be pulled away from the convex periphery 42 of the spa. The concave nature 46 of the elevated waterfall surface is addressed in the same manner (See FIG. 4) and suffers from the same drawbacks enumerated previously.

Figure 6:
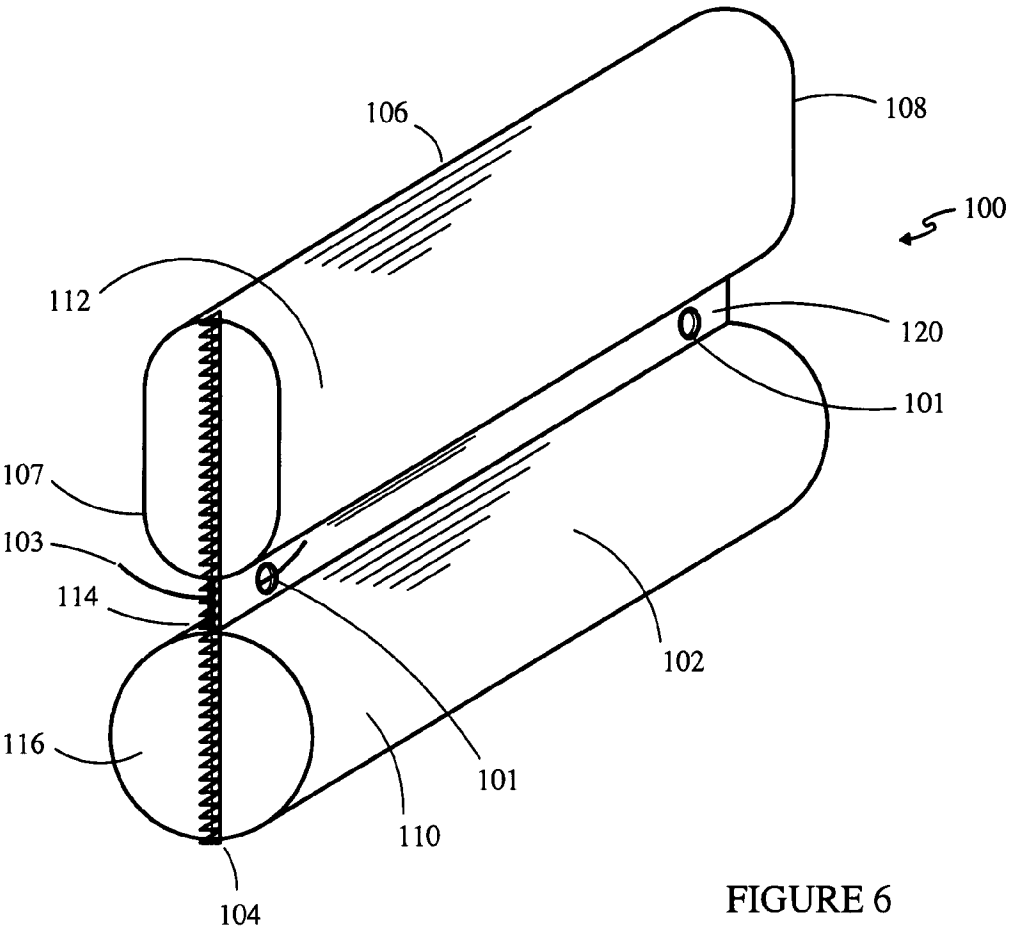
FIG. 6 is a perspective view of Applicant's gap eliminator.
Figure 7:
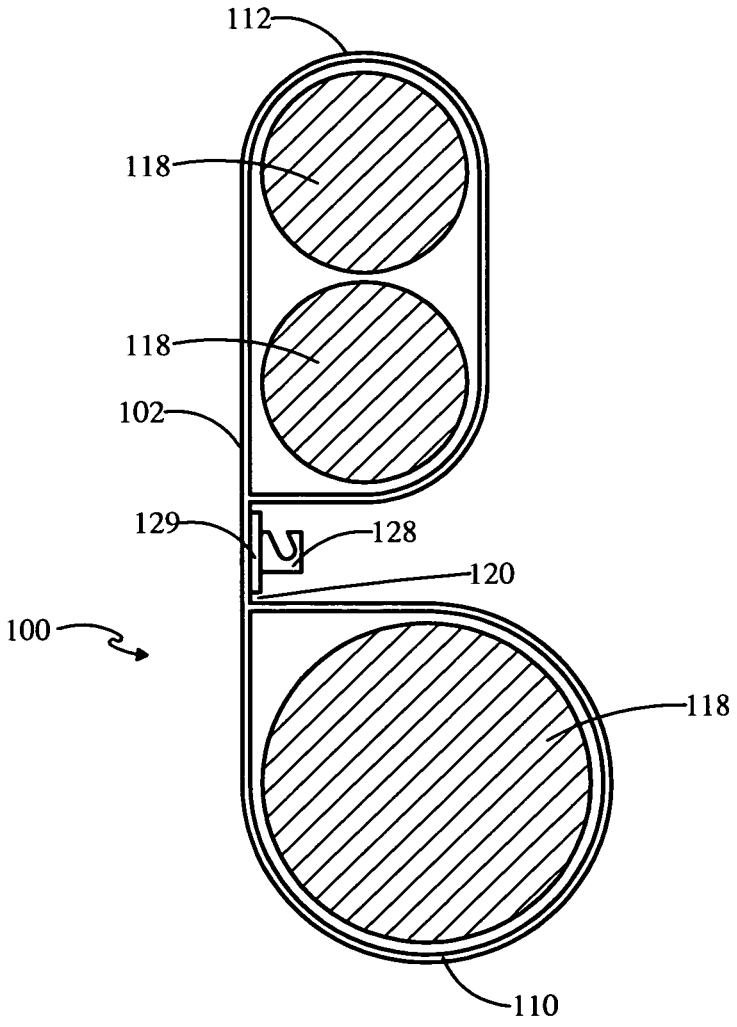
FIG. 7 is an end cross sectional view of the gap eliminator of FIG. 6.

FIG. 6 is a perspective view of a first embodiment of Applicant's gap eliminator, and FIG. 7 is an end cross-sectional view of the gap eliminator illustrated in FIG. 6. Gap eliminator 100 is generally longitudinal in shape preferably being formed from a sheet of resilient pliable waterproof material which when folded in half and sewn or heat sealed on a longitudinal axis, presents the following structure. When positioned in a planar orientation gap eliminator 100 has an upper surface 102, having lateral edges 104 and 106, and lower surface 107. The resilient pliable fabric is joined as a result of sewing or heat sealing so as to form a plurality of longitudinal sleeves. First sleeve 110 defines an interior channel along lateral edge 104. A second sleeve 112 extends along lateral edge 106 separated from first sleeve by a web portion 120. First sleeve 110 has a larger diameter than second sleeve 112. The gap eliminator 100 may be closed at end 108 and access to first and second sleeves 110 and 112 is by means of a zipper type access 114 at second end 116 or both ends may have a zipper type access. First sleeve 110 and second sleeve 112 are designed to receive and accommodate weighted, but buoyant material, such as a polyethylene, polystyrene, or styrofoam rods 118 dimensioned to be slidably receivable within the respective sleeves. First sleeve 110 is designed to receive a single rod preferably of greater diameter and second sleeve 112 is designed to receive at least two rods preferably of smaller diameter.

Figure 10:
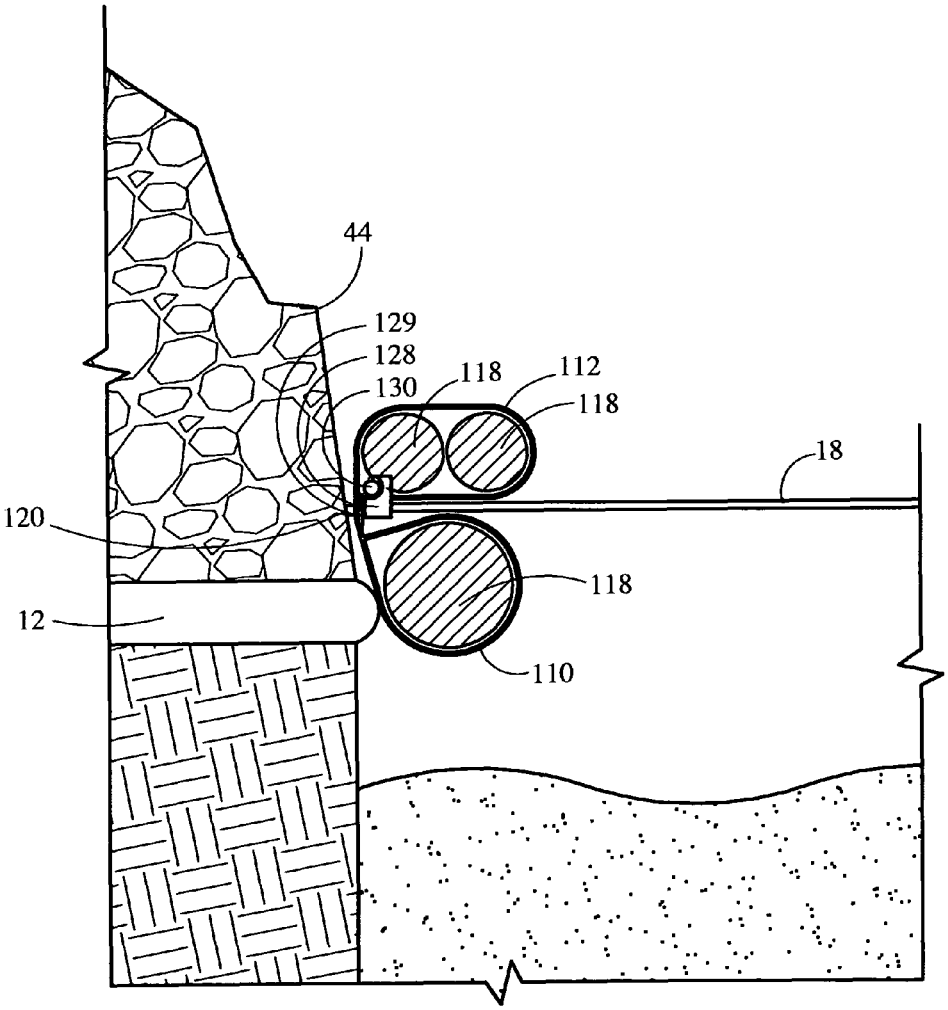
FIG. 10 is a side cross sectional view of the gap eliminator of FIG. 6 installed in conjunction with a pool cover and the cable assembly of FIG. 9.

A detailed description of the installation of the gap eliminator 100 will follow, but to appreciate the structural design of gap eliminator 100, reference is now made to FIG. 10 which is a cross-sectional view of the installation of the gap eliminator 100 to a pool which includes a raised wall 44 which may be straight or arcuate, such as a waterfall or the like, which is above the coping 12 and deck or apron of the pool, and thus prevents the pool cover 18 from being drawn a distance across the edge of the coping 12 before being secured to the deck or apron as heretofore discussed.

The gap eliminator 100 cooperates with the installation of a plurality of cable guides 128 which are spaced apart across the face of the vertical wall 44 and embedded therein to secure a cable 130 in close fitting relationship with the face of the wall 44. The pool cover 18 will be clipped on to cable 130. However, the gap eliminator 100 is installed when the cable guides 128 are installed into the face of the wall. Slight apertures are cut along the longitudinal web portion 120 between first and second sleeves 110 and 112 so that the web portion 120 can be secured and abut the face of the wall 44 when the cable guides 128 and washer 129 are installed. The cable 130 is then secured to cable guide 128. The cover 18 is then installed to the cable 130 with second sleeve 112 containing two of the weighted buoyant rods 118 positioned on the top of the pool cover while the first sleeve 110 containing the larger diameter weighted yet buoyant rod 118 is positioned on the underside of cover 18, thus insuring closure of any gap which may exist between the cable securing the pool cover and the wall of the raised wall surface.

Figure 8:
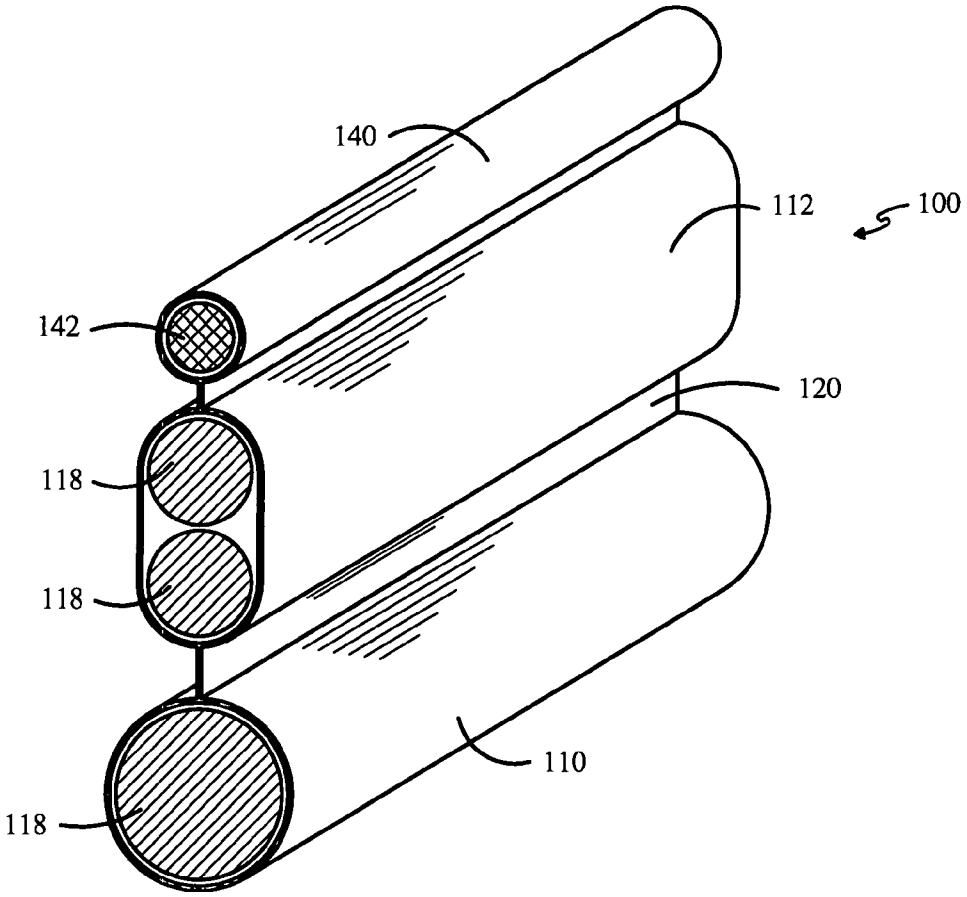
FIG. 8 is a perspective view of the second embodiment of the gap eliminator as illustrated in FIG. 6.
Figure 11:
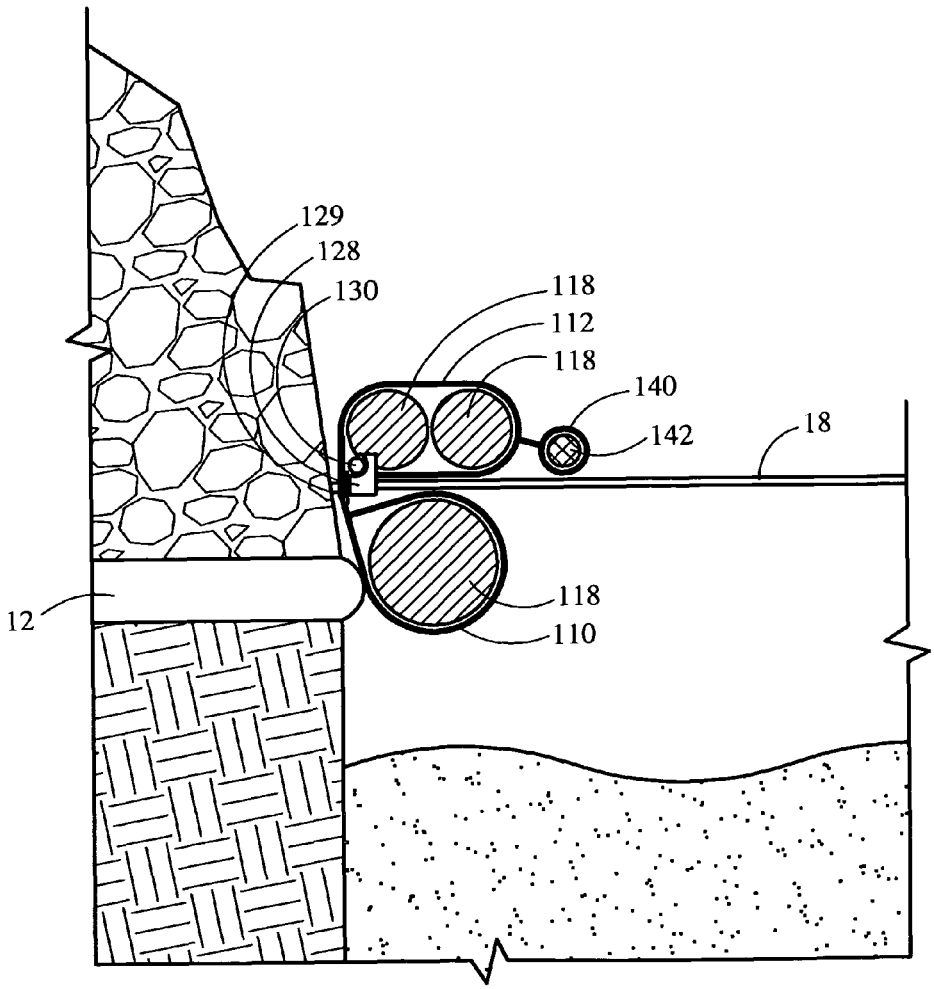
FIG. 11 is a side cross sectional view of a gap eliminator of the embodiment illustrated in FIG. 8 installed in conjunction with a pool cover and the cable assembly of FIG. 9.

FIG. 8 is an end cross-sectional view of a second embodiment of the gap eliminator 100 and FIG. 11 is a cross-sectional view of the second embodiment of the gap eliminator installed. The second embodiment of the gap eliminator is identical to the first embodiment with the exception of the addition of a third sleeve 140 formed adjacent the second sleeve 112. Access to this third sleeve is identical to that of the first embodiment by means of zippered end. Third sleeve 140 is designed for those climate areas which might encounter severe winter conditions. In such conditions, the weighted, yet buoyant polystyrene, polyethylene or styrofoam rods 118 originally positioned within second sleeve 112 may need some additional weight. Third sleeve 140 is designed to accommodate a weighted non-buoyant rod 142 of greater density than those previously discussed or third sleeve 140 could be filled with a weighted substance, such as sand or the like, positioned in a sealable container or containers and slidably positioned within sleeve 140, which could be easily installed in third sleeve 140 and easily removed and discarded when the pool cover is removed for the season. FIG. 11 illustrates that this second embodiment of the gap eliminator is installed in the same manner as the first embodiment.

Figure 9:
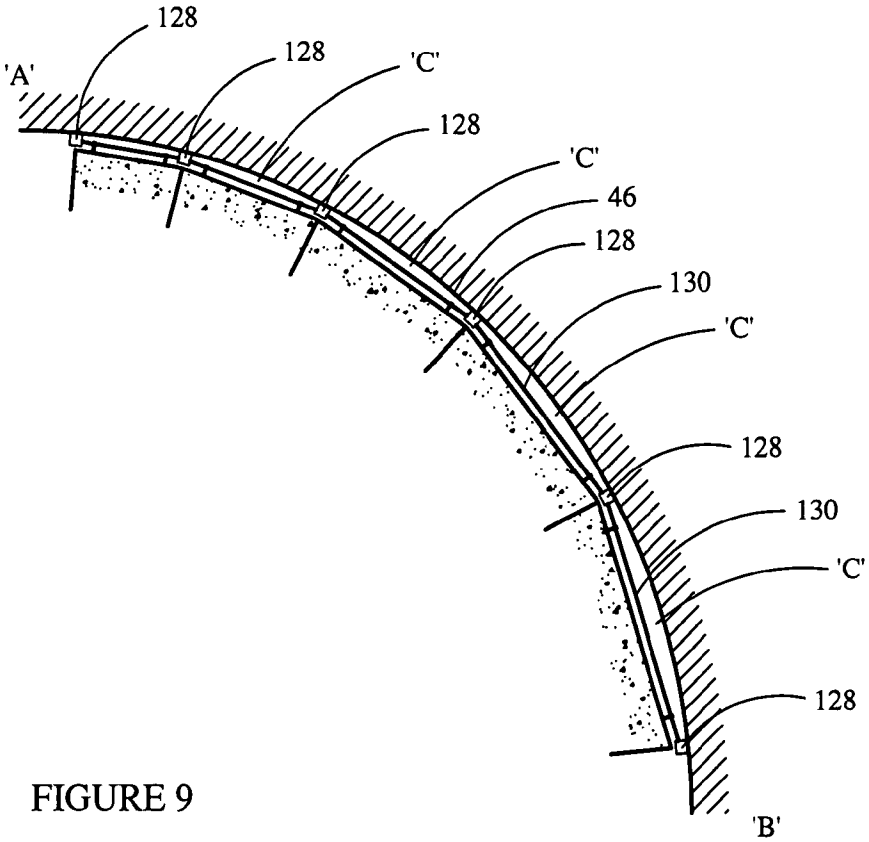
FIG. 9 is a top view of a cable installation for use with a concave waterfall area of a pool.

FIG. 9 illustrates the installation of the cable guides 128 utilized to secure cable 130 about the face of a concave arcuate wall such as a water fall for the installation of the gap eliminator 100. The cable guides 128 are installed in spaced apart relationship and the gap eliminator 100 would be simultaneously positioned with the cable guides before securing cable 130 to the cable guides.

FIG. 9 also illustrates the gap problem associated with an arcuate raised wall. The spacing of the cable guides 128 as illustrated in FIG. 9 increases from end A to end B. The closer the spacing the smaller the gap C, thus the area of the gap increases from end A to end B as a result of the increase spacing. It is this gap which existed in the prior art which the Applicant has addressed with respect to the gap eliminator. Regardless of the spacing of the cable guides, the gap eliminator, being secured to the cable guides 128, will cover and eliminate the gap C. The actual spacing of the cable guides 128 will be dictated by the length of the wall, the curvature of the wall, and the aesthetics desired by the owner of the pool.

The web portion 120 between first and second sleeves 110 and 112 can have a plurality of small slits formed by the installer to allow the installer to pass the cable guide 128 through the slit and into a threaded bore formed in the face of the arcuate wall. A washer 129 (see FIG. 7) sandwiches the web portion 120 between washer 129 and the wall. In this manner, the installer, in the field, can insure that the plurality of slits required will coincide with the location of a cable guide 128 in order to provide for a snug fit.

It will also be recognized by those with skill in the art, that the radius of the ark of the raised wall may vary. Therefore the gap eliminator may have a continuous rod installed in its sleeves 110 and 112 for the entire length of the gap eliminator 100, or there may be a plurality of rods spaced end to end, of a shorter length in order to accommodate and allow for the gap eliminator 100 to become more arcuate to accommodate a wall of greater curvature. Still further, it will be recognized that depending upon the length of the wall and its concavity, it is possible that more than one gap eliminator would need to be installed end to end in order to span the distance of the walls concavity. In such instances the ends of the gap eliminators 100 may be formed with grommets 101 for receipt of tie downs 103 securing adjacent gap eliminators 100 (See FIG. 6).

Figure 12:
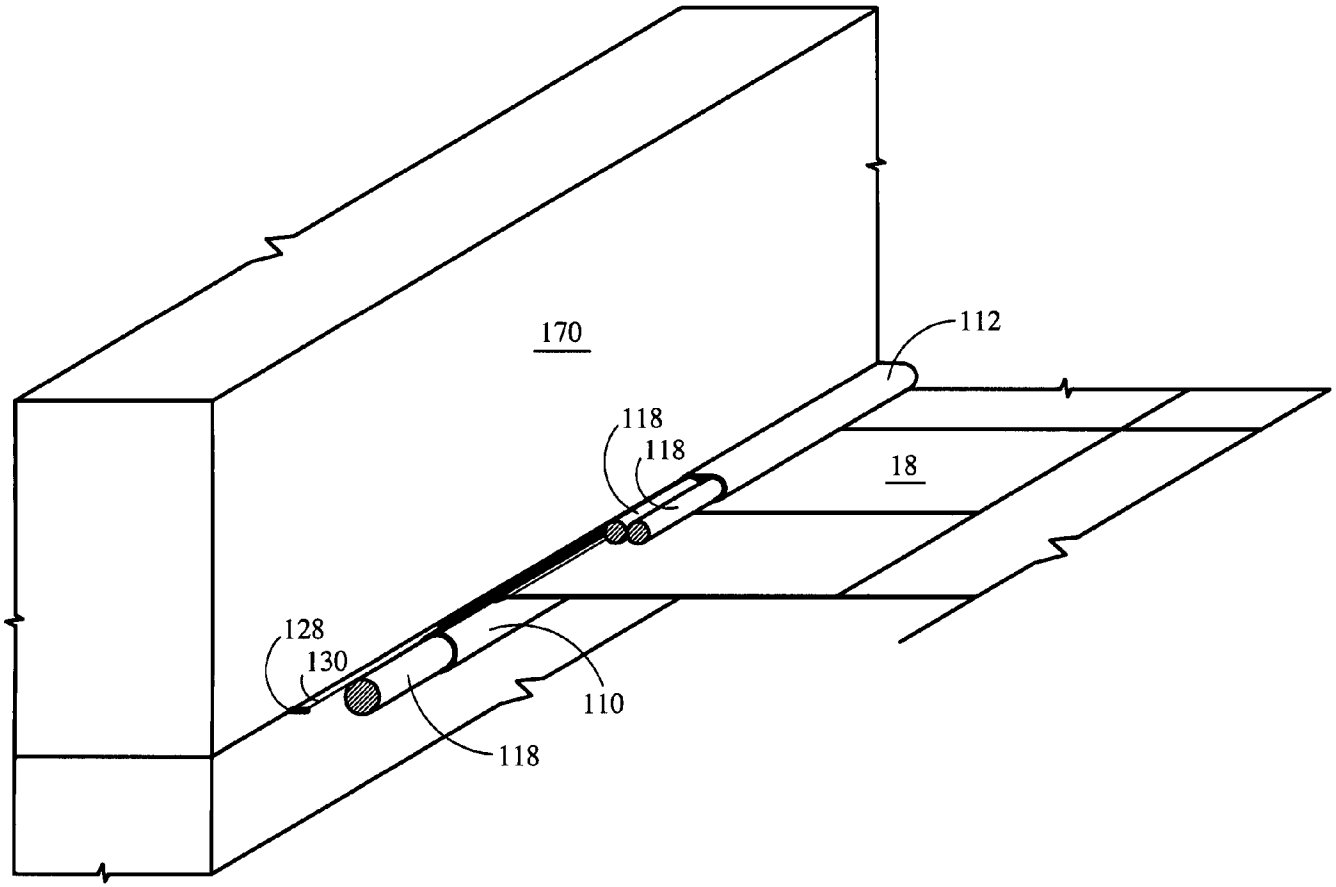
FIG. 12 is a perspective partial cutaway view of the installed gap eliminator of FIG. 6, along an elevated, straight wall.
Figure 13:
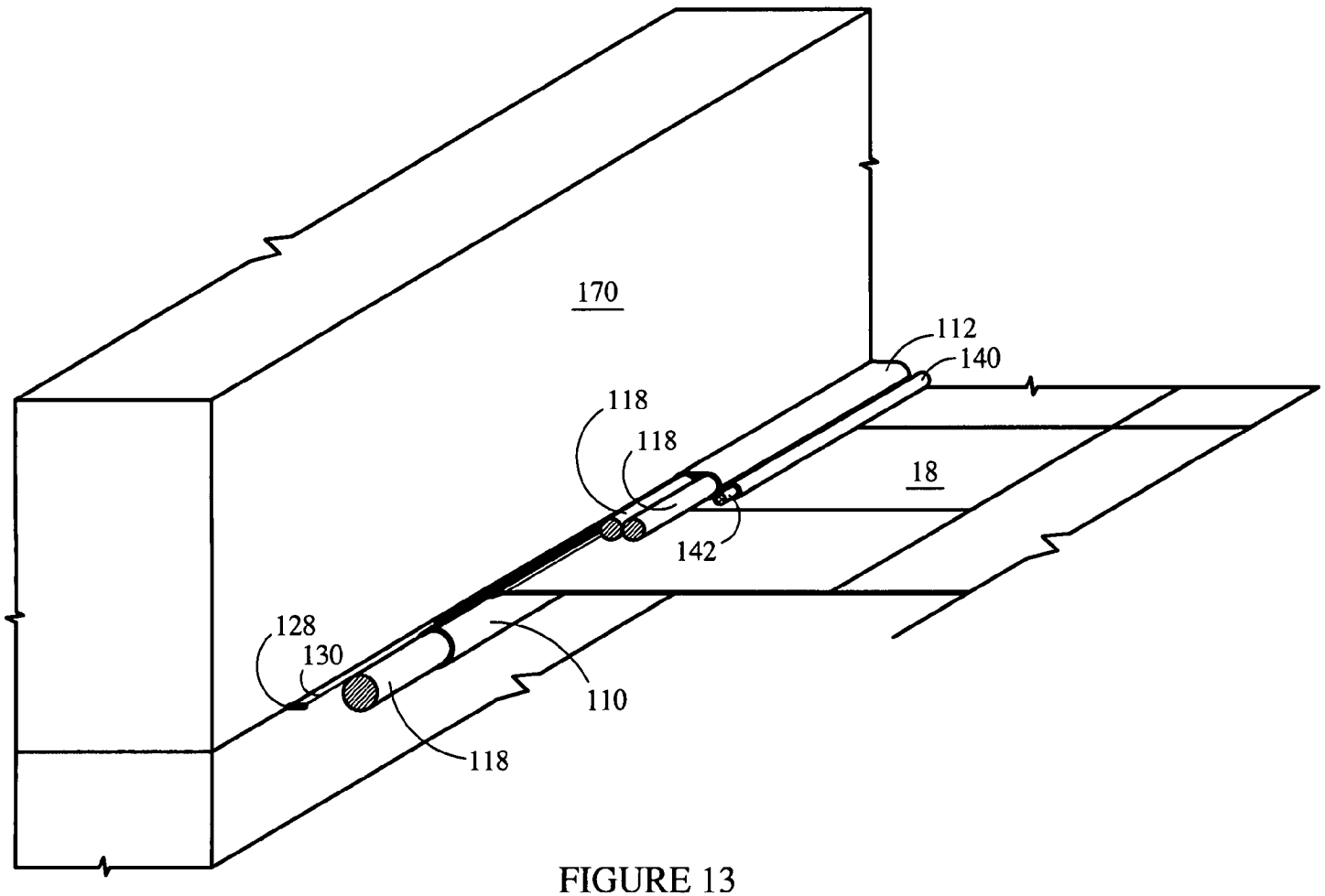
FIG. 13 is a perspective partial cutaway view of the second embodiment of the gap eliminator of FIG. 8 installed against an elevated straight wall.

FIGS. 12 and 13 are perspective partial cutaway views illustrating the installation of the first and second embodiments of the gap eliminator 100 and pool cover adjacent an elevated straight wall 170 of a pool which is not concave nor convex. Modern architectural designs of pools oftentimes include multi-levels about the pool surface such that the pool coping and the apron or deck are not all on the same level. Applicant's gap eliminator 100 can also accommodate these designs in the same manner as described with respect to convex or concave raised walls. The reference numbers in FIGS. 12 and 13 and the structural elements to which they refer are identical as previously discussed with FIG. 10 illustrating the installation of the first embodiment of the gap eliminator 100 and FIG. 11 illustrating the second embodiment of the gap eliminator 100 with the additional third sleeve 140 and added weight component.

Figure 14:
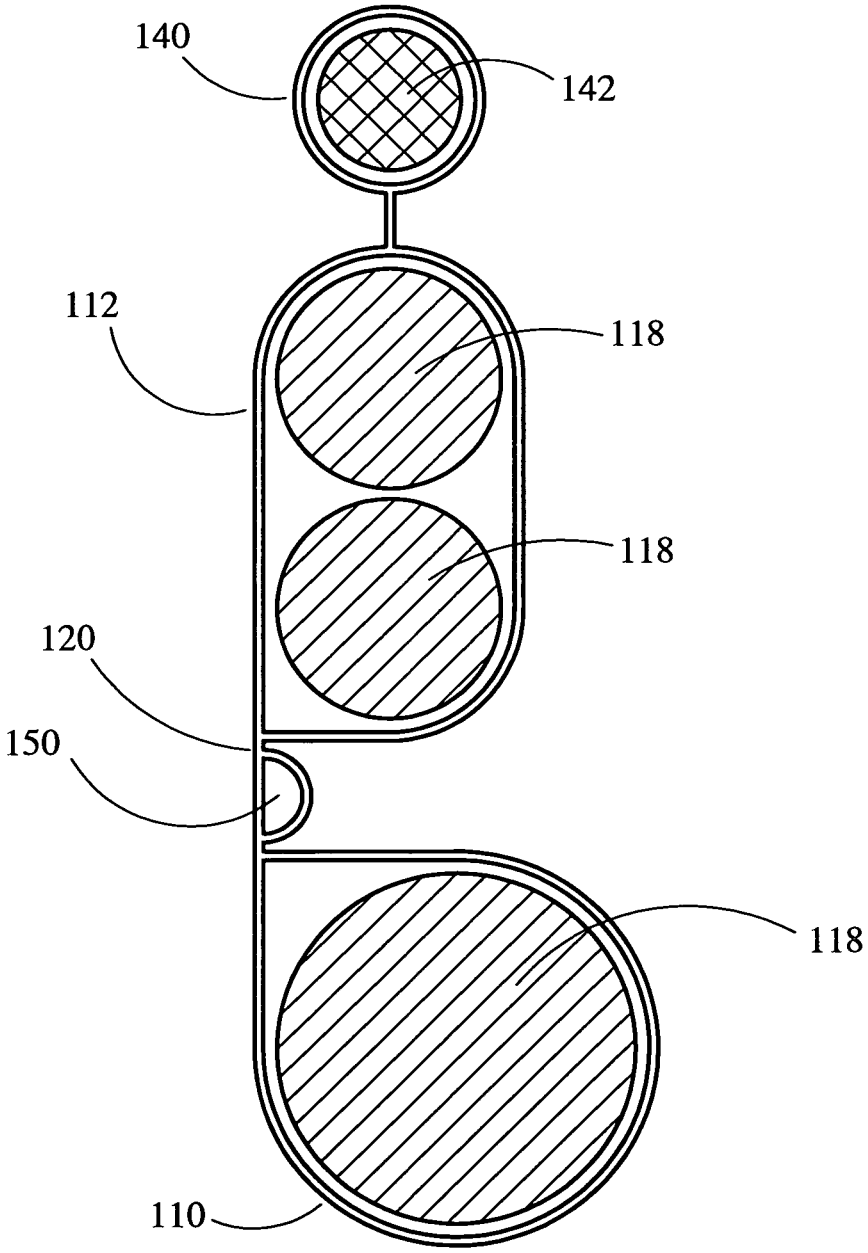
FIG. 14 is a cross-section of a gap eliminator of the present invention incorporating a unitary cable sleeve.

In those rare instances where cable guides 128 cannot be affixed to the wall be it concave or convex, a modified gap eliminator would be fabricated with a cable sleeve 150 formed longitudinally in the web 120 of the gap eliminator. Cable sleeve 150 would extend the length of the gap eliminator and would be in alignment with the web portion 120 between first and second sleeves 110 and 112 on the lower surface of the gap eliminator. This modification is illustrated in FIG. 14 which is a cross-sectional view of this modification. It does not lend itself to the optimum solution, but will close a gap. The cable sleeve may receive a standard cable or to better close a gap, a cable made of deformable material which would adapt to the desired curvature could be extended through the cable sleeve 150 and then adapted to the curvature by the installers which would further eliminate any gap.

Figure 15:
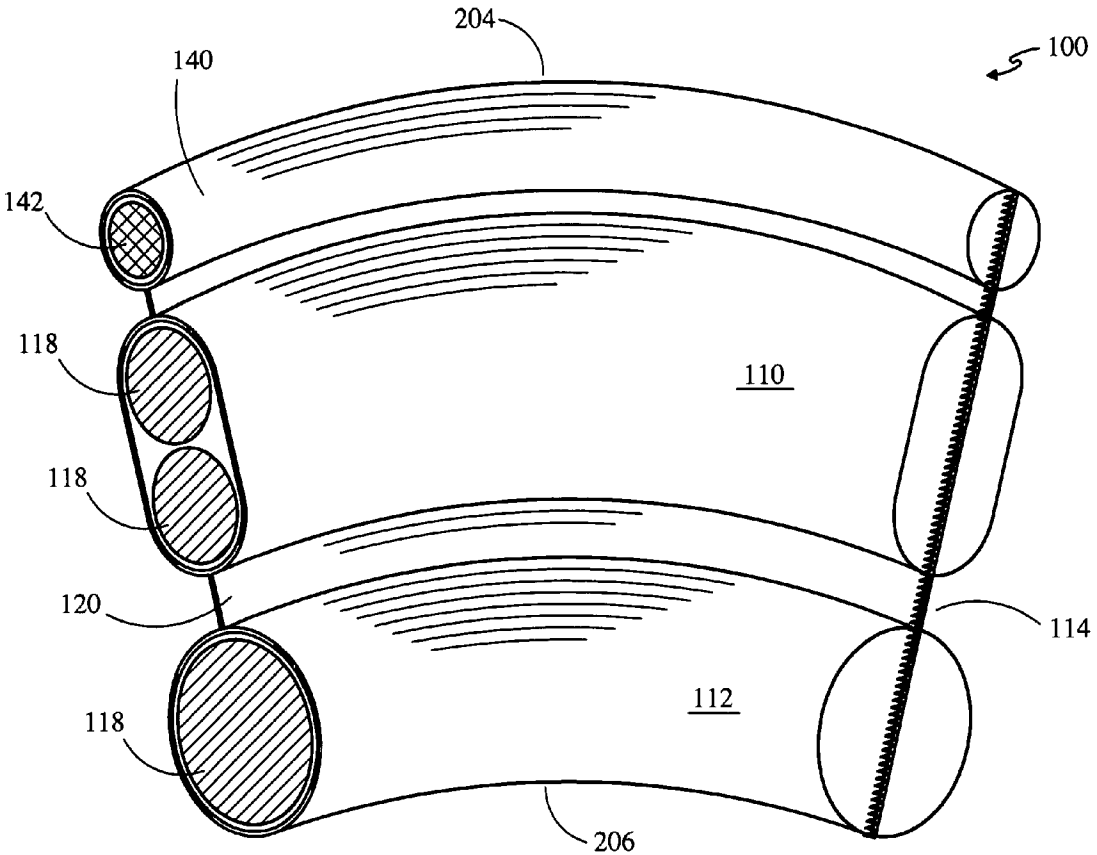
FIG. 15 is a perspective view of a gap eliminator of the present invention which is longitudinally arcuate to custom fit and abut an arcuate elevated wall of a pool.

The embodiments of the gap eliminator heretofore described are longitudinally straight in their fabrication and shape. The rods utilized for insertion into first sleeves 110 and second sleeves 112, constructed of polyethylene, polystyrene or styrofoam, are also somewhat flexible or alternatively they are segmented to allow for the generally longitudinal straight gap eliminator to be formed into an arcuate shape to match the arcuate shape of the elevated wall of the pool. The gap eliminator, however, may also be fabricated in an arcuate shape to either custom fit a particular arcuate wall of a pool, or it could be fabricated in an arcuate shape, the arch having a particular radius to accommodate what are standardized radii of arcuate elevated walls associated with pools and spas. FIG. 15 is a perspective view illustrating a particular arcuate gap eliminator 100 constructed in the same manner as the embodiments illustrated in FIGS. 6 and 8 with the exception that the lateral edges 204 and 206 are arcuate. The sleeve construction and the closure means would be identical to those previously illustrated. The gap eliminator illustrated in FIG. 15 would utilize the resilient, flexible type of polyethylene, polystyrene or Styrofoam rods 118 as used and illustrated with respect to FIGS. 6 and 8. In the embodiment illustrated in FIG. 15, the rods 118 would be resilient and flexible to accommodate the curvature of the sleeves 110 and 112 or the rods could be segmented to further cooperate with the curvature of the gap eliminator 100 illustrated in FIG. 15. Third sleeve 140 having a weighted container slidably secured therein, the weighted container not having the flexibility of the rods in sleeves 110 and 112 would require a plurality of weights to be slidably inserted in order to accommodate the curvature of the gap eliminator.

It will be recognized by those of ordinary skill in the art that the gap eliminator described heretofore can be made in any convenient length. Consideration must be had for the fact that the gap eliminator when not in use must be stored, and therefore convenient lengths for both storage and usage must be considered. Still further, the gap eliminator as described, adapts to the curvature of a wall to which it is attached because of its resilient pliant outer shell and the resilient pliancy of the weighted yet buoyant rods slidably received within the shell. It should be recognized that if so desired, a gap eliminator of the type described could be specifically fabricated for a defined radius wall in which the gap eliminator is fabricated to the exact radius and curvature of such wall.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. An improved swimming pool cover assembly for raised wall shaped pools and spas, the assembly comprising:

a pool cover shaped to extend across said pool or spa surface, said pool cover anchored in a plurality of anchor bolts embedded in a decking about said pool or spa, a portion of said pool cover abutting a straight or arcuate raised wall of said pool or spa;

a plurality of cable guides horizontally alignably embedded into said raised wall of a pool or spa at a height equal to a said decking of said pool or spa;

a cable having a first anchored end, said cable extending across said raised wall to a second anchored end, said cable frictionally engaged in said cable guides embedded in said raised wall, said portion of said pool cover abutting said raised wall of said pool or spa anchored to said cable extending across said raised wall on said cable guides;

a gap eliminating bumper comprising a flexible, longitudinal member defined by a central longitudinal web having first and second parallel, longitudinal sleeves positioned on each opposing longitudinal edge of said web, said first and second longitudinal sleeves selectively open at least one end for the insertion of one or more weighted rod members, said web having selective apertures formed therein for positioning said web over said cable guides and between said raised wall and said cable guide, said first longitudinal sleeve and weighted buoyant rod member positioned below said cable and said second longitudinal sleeve and weighted buoyant rod members positioned above said cable sandwiching said portion of said pool cover attached to said cable between said longitudinal sleeves and weighted buoyant rod members and eliminating any gap between said pool cover and said raised wall.

2. The improved swimming pool cover assembly in accordance with claim 1 wherein said first longitudinal sleeve of said gap eliminating bumper is dimensioned to accommodate a single weighted buoyant rod member.

3. The improved swimming pool cover assembly in accordance with claim 1 wherein said second longitudinal sleeve of said gap eliminating bumper is dimensioned to accommodate two parallel weighted buoyant rod members.

4. The improved swimming pool cover assembly in accordance with claim 1 wherein said weighted buoyant rod members slidably insertable into said first and second longitudinal sleeves of said gap eliminating bumper are of one piece flexible, resilient construction adaptable to said arcuate raised wall.

5. The improved swimming pool cover assembly in accordance with claim 1 wherein said weighted buoyant rod members slidably insertable into said first and second longitudinal sleeves of said gap eliminating bumper are of segmented construction, independently displaceable within said respective sleeve to said arcuate raised wall.

6. The improved swimming pool cover assembly in accordance with claim 1 wherein said weighted buoyant rod members are fabricated of polystyrene, polyethylene, or styrofoam.

7. The improved swimming pool cover assembly in accordance with claim 1 wherein a third longitudinal sleeve is formed adjacent said second longitudinal sleeve.

8. The improved swimming pool cover assembly in accordance with claim 7 wherein said third longitudinal sleeve slidably receives a plurality of weighted non-buoyant tubes, said weighted non-buoyant tubes having a density greater than the density of said weighted buoyant rods in said first and second sleeves.

9. The improved swimming pool cover assembly in accordance with claim 1 wherein said gap eliminating bumper is formed with two arcuate edges and arcuate first, second, and third longitudinal sleeves.

10. The improved swimming pool cover assembly in accordance with claim 1 wherein said gap eliminating bumper is formed with a securing means proximate each longitudinal end permitting the securing of abutting gap eliminating bumpers to each other.

11. A gap eliminating bumper cooperative with a swimming pool cover for covering raised wall shaped pools and spas, the gap eliminating bumper cooperative with a pool cover shaped to extend across a pool or spa surface, said pool cover anchored in a plurality of anchor bolts embedded in the decking about the pool or spa, a portion of said pool cover abutting a straight or arcuate raised wall of said pool or spa, said gap eliminating bumper further cooperative with a plurality of cable guides horizontally alignably embedded in said raised wall of said pool or spa at a height equal to said decking of said pool or spa, and a cable having a first anchored end, said cable extending across said raised wall to a second anchored end, said cable frictionally engaged in said cable guides embedded in said raised wall, said portion of said pool cover abutting said raised wall of said pool or spa anchored to said cable extending across said raised wall on said cable guides, said gap eliminating bumper comprising:

a flexible longitudinal member defined by a central longitudinal web having first and second parallel, longitudinal sleeves positioned on each opposing longitudinal edge of said web, said first and second longitudinal sleeve selectively open at least one end for the insertion of one or more weighted buoyant rod members, said web having selective apertures formed therein for positioning said web over said cable guides and between said raised wall and said cable guides, said first longitudinal sleeve and weighted buoyant rod member positioned below said cable and said second longitudinal sleeve and weighted buoyant rod members positioned above said cable, sandwiching said portion of said pool cover attached to said cable between said longitudinal sleeves and weighted buoyant rod members, and eliminating any gap between said pool cover and said raised wall.

12. The gap eliminating bumper in accordance with claim 11 wherein said first longitudinal sleeve of said gap eliminating bumper is dimensioned to accommodate a single weighted buoyant rod member.

13. The gap eliminating bumper in accordance with claim 11 wherein said second longitudinal sleeve of said gap eliminating bumper is dimensioned to accommodate two parallel weighted buoyant rod members.

14. The gap eliminating bumper in accordance with claim 11 wherein said weighted buoyant rod members slidably insertable into said first and second longitudinal sleeves of said gap eliminating bumper are of one piece flexible, resilient construction adaptable to said arcuate raised wall.

15. The gap eliminating bumper in accordance with claim 11 wherein said weighted buoyant rod members slidably insertable into said first and second longitudinal sleeves of said gap eliminating bumper are of segmented construction, independently displaceable within said respective sleeve to said arcuate raised wall.

16. The gap eliminating bumper in accordance with claim 11 wherein said weighted buoyant rod members are fabricated of polystyrene, polyethylene, or styrofoam.

17. The gap eliminating bumper in accordance with claim 11 wherein a third longitudinal sleeve is formed adjacent said second longitudinal sleeve.

18. The gap eliminating bumper in accordance with claim 17 wherein said third longitudinal sleeve slidably receives a plurality of weighted non-buoyant tubes, said weighted non-buoyant tubes having a density greater than the density of said weighted buoyant rods in said first and second sleeves.

19. The gap eliminating bumper in accordance with claim 11 wherein said gap eliminating bumper is formed with two arcuate edges and arcuate first, second, and third longitudinal sleeves.

20. The gap eliminating bumper in accordance with claim 11 wherein said gap eliminating bumper is formed with a securing means proximate each longitudinal end permitting the securing of abutting gap eliminating bumpers to each other.

21. A method for covering a swimming pool or spa wherein the swimming pool or spa has raised walls which extend above the decking and coping of the swimming pool or spa. The method comprising:

a. forming a plurality of threaded bores on a raised wall of said swimming pool and spa at selected spaced apart intervals at a level of the coping and decking of said swimming pool or spa;

b. positioning a longitudinal web of a gap eliminating bumper in alignment with said threaded bores;

c. forming an aperture in said web of said gap eliminating bumper in alignment with said threaded bore;

d. inserting a threaded cable guide through said slit in said web of said gap eliminating bumper and threadedly securing said cable guide in said threaded bore, said cable guide having a washer positioned thereon, said washer capturing a portion of said web of said gap eliminating bumper between said washer and said raised wall;

e. anchoring a taut cable at opposing ends of said raised wall, said taut cable extending through said cable guides;

f. extending a pool cover across said swimming pool or spa surface and anchoring said pool cover to a plurality of anchor bolts embedded in said decking about said swimming pool or spa;

g. affixing said pool cover adjacent said raised wall to said cable extending through said cable guides, said pool cover affixed by means of clips;

h. adjusting the taughtness of said pool cover about said swimming pool or spa.

22. The method for covering a swimming pool or spa in accordance with claim 21 wherein said gap eliminating bumper comprises:

a flexible, longitudinal member defined by a central longitudinal web having first and second parallel, longitudinal sleeves positioned on each opposing longitudinal edge of said web, said first and second longitudinal sleeves selectively open at least one end for the insertion of one or more weighted rod members, said web having selective apertures formed therein for positioning said web over said cable guides and between said raised wall and said cable guide, said first longitudinal sleeve and weighted buoyant rod member positioned below said cable and said second longitudinal sleeve and weighted buoyant rod members positioned above said cable sandwiching said portion of said pool cover attached to said cable between said longitudinal sleeves and weighted buoyant rod members and eliminating any gap between said pool cover and said raised wall.

23. The method for covering a swimming pool or spa in accordance with claim 22 wherein said first longitudinal sleeve of said gap eliminating bumper is dimensioned to accommodate a single weighted buoyant rod member.

24. The method for covering a swimming pool or spa in accordance with claim 22 wherein said second longitudinal sleeve of said gap eliminating bumper is dimensioned to accommodate two parallel weighted buoyant rod members.

25. The method for covering a swimming pool or spa in accordance with claim 22 wherein said weighted buoyant rod member is slidably insertable into said first and second longitudinal sleeves of said gap eliminating bumper or a one piece flexible, resilient construction adaptable to abut an arcuate raised wall.

26. The method for covering a swimming pool or spa in accordance with claim 22 wherein said weighted buoyant rod members are fabricated of polystyrene, polyethylene, or styrofoam.

27. The method for covering a swimming pool or spa in accordance with claim 22 wherein a third longitudinal sleeve is formed adjacent said second longitudinal sleeve on said gap eliminating bumper.

28. The improved swimming pool cover assembly in accordance with claim 27 wherein said third longitudinal sleeve slidably receives a plurality of weighted non-buoyant tubes, said non-buoyant tubes having a density greater than the density of said weighted buoyant rods and said first and second sleeves.

* * * * *